US012245733B2

(12) United States Patent
Hughett

(10) Patent No.: US 12,245,733 B2
(45) Date of Patent: Mar. 11, 2025

(54) DUSTPAN ACCESSORY TOOL FOR VACUUM CLEANER

(71) Applicant: TECHTRONIC CORDLESS GP, Anderson, SC (US)

(72) Inventor: Stephen A. Hughett, Anderson, SC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 17/732,812

(22) Filed: Apr. 29, 2022

(65) Prior Publication Data

US 2022/0346622 A1 Nov. 3, 2022

Related U.S. Application Data

(60) Provisional application No. 63/183,305, filed on May 3, 2021.

(51) Int. Cl.

| | |
|---|---|
| ***A47L 5/38*** | (2006.01) |
| ***A47L 9/02*** | (2006.01) |
| ***A47L 13/52*** | (2006.01) |

(52) U.S. Cl.

CPC ..... *A47L 13/52* (2013.01); *A47L 5/38* (2013.01); *A47L 9/02* (2013.01)

(58) Field of Classification Search

CPC ..... A47L 13/38; A47L 13/52; A47L 13/362; A47L 13/327; A47L 7/0004;

(Continued)

(56) References Cited

U.S. PATENT DOCUMENTS 2,242,278 A 5/1941 Yonkers, Jr.
5,839,157 A * 11/1998 Strauser ..... E01H 1/0836 15/418

(Continued)

FOREIGN PATENT DOCUMENTS

CA 2301424 A1 9/2001
CN 2726515 Y 9/2005

(Continued)

OTHER PUBLICATIONS

Extended European Search Report for Application No. 22171072.6 dated Jan. 23, 2023 (10 pages).

*Primary Examiner* — Brian D Keller
*Assistant Examiner* — Sidney D Full
(74) *Attorney, Agent, or Firm* — Michael Best & Friedrich LLP

(57) ABSTRACT

A vacuum cleaner includes a body movable over a surface to be cleaner, a suction source positioned in the body, and a suction port in fluid communication with the suction source. The body includes a plurality of feet. A dustpan attachment is removably coupled to the body. The dustpan attachment includes a housing having a recess and a vacuum port fluidly coupled to the suction port, and a pair of flanges extending from the housing. Each flange is removably coupled to a respective one of the plurality of feet. When each of the pair of flanges is coupled to a respective one of the plurality of feet, the recess cooperates with the surface to form a suction channel having a suction inlet formed in a front of the housing and opening forwardly, wherein the suction inlet is in fluid communication with the suction port.

22 Claims, 5 Drawing Sheets

(58) Field of Classification Search
CPC .. A47L 7/0009; A47L 7/00014; A47L 7/0066; A47L 7/0071; A47L 9/02; A47L 9/0693; A47L 9/0673; A47L 9/10; A47L 11/4044; A47L 11/4036; A47L 7/0014; A47L 9/102; A47L 5/362; A47L 9/327; A47L 5/38
USPC ..... 15/415.1, 301
See application file for complete search history.

(56) References Cited

U.S. PATENT DOCUMENTS

| | | | | |
|---|---|---|---|---|
| 6,584,640 | B2 | 7/2003 | Vanderlinden | |
| 6,601,266 | B1 | 8/2003 | Faraci et al. | |
| 7,412,749 | B2 | 8/2008 | Thomas et al. | |
| 7,877,839 | B2 * | 2/2011 | Phelan | A47L 7/0009 15/354 |
| 8,556,135 | B2 | 10/2013 | Edmondson | |
| 8,938,849 | B2 | 1/2015 | Cleary | |
| 11,071,425 | B2 * | 7/2021 | Westbrook | A47L 9/0693 |
| 2006/0026790 | A1 | 2/2006 | Consilvio | |
| 2008/0271283 | A1 | 11/2008 | Thomas et al. | |
| 2011/0296644 | A1 | 12/2011 | Grassman | |
| 2012/0210539 | A1 | 8/2012 | Diminick et al. | |
| 2015/0265115 | A1 * | 9/2015 | Gray | A47L 9/242 15/415.1 |
| 2017/0319043 | A1 | 11/2017 | Kerntopf et al. | |
| 2020/0187737 | A1 | 6/2020 | Croggon et al. | |
| 2021/0347090 | A1 | 11/2021 | Holzmeier | |

FOREIGN PATENT DOCUMENTS

| | | | |
|---|---|---|---|
| CN | 101524256 | A | 9/2009 |
| CN | 204306782 | U | 5/2015 |
| CN | 204909336 | U | 12/2015 |
| CN | 204919454 | U | 12/2015 |
| CN | 206687671 | U | 12/2017 |
| CN | 211484434 | U | 9/2020 |
| ES | 1230529 | U | 6/2019 |
| JP | 3178558 | U | 9/2012 |
| WO | 2009106612 | A1 | 9/2009 |
| WO | 2017197483 | A1 | 11/2017 |

* cited by examiner

DUSTPAN ACCESSORY TOOL FOR VACUUM CLEANER

CROSS-REFERENCE TO RELATED APPLICATIONS

This application claims priority to U.S. Provisional Patent Application No. 63/183,305, filed on May 3, 2021, the entire contents of which are incorporated herein by reference.

FIELD OF THE INVENTION

The present invention relates to accessory tools for vacuum cleaners, and more particularly to a dustpan vacuum cleaner accessory tool.

BACKGROUND OF THE INVENTION

Vacuums typically include impeller units which generate suction fluid flow into a separator which separates suction debris from an airflow. Vacuums include dirty fluid inlets in fluid communication with the impeller unit to direct dirty fluid from work surfaces and into the separator. Occasionally, dirty fluid inlets are provided by hoses coupled to the separator. Suction nozzle attachments or other accessory tools are removably attached to the separator via the hose to extend the reach of the suction.

SUMMARY OF THE INVENTION

The disclosure provides, in one aspect, a vacuum cleaner including a body movable over a surface to be cleaner, a suction source positioned in the body, and a suction port in fluid communication with the suction source. The body includes a plurality of feet. A dustpan attachment is removably coupled to the body. The dustpan attachment includes a housing having a recess and a vacuum port fluidly coupled to the suction port, and a pair of flanges extending from the housing. Each flange is removably coupled to a respective one of the plurality of feet. When each of the pair of flanges is coupled to a respective one of the plurality of feet, the recess cooperates with the surface to form a suction channel having a suction inlet formed in a front of the housing and opening forwardly, wherein the suction inlet is in fluid communication with the suction port.

The disclosure provides, in another independent aspect, a dustpan attachment for use with a vacuum cleaner configured to clean a surface. The vacuum cleaner includes a body, a suction port, and a suction source disposed in the body for generating airflow through the suction port. The dustpan attachment includes a housing, a vacuum port extending through the housing, and a recess defined within the housing. The vacuum port is configured to fluidly couple to the suction port. The housing includes a top wall and a plurality of walls extending from the top wall to a bottom edge. The bottom edge is configured to contact the surface. When the bottom edge contacts the surface, the recess is configured to cooperate with the surface to form a suction channel having a suction inlet in communication with the vacuum port and formed in a front of the housing and opening forwardly. A pair of flanges extends from the housing and is configured to removably couple to the body.

The disclosure provides, in another independent aspect, a method of using a dustpan attachment with a vacuum cleaner to clean a surface. The vacuum cleaner includes a body, a suction source positioned within the body, and a suction port in fluid communication with the suction source.

The method includes connecting a pair of attachment features on the dustpan attachment to a pair of mounting features of the vacuum cleaner, thereby positioning the dustpan attachment adjacent the surface and forming a suction inlet at a front thereof. Then, connecting the suction port with a vacuum port of the dustpan attachment. Then, operating the suction source to draw air through the suction inlet into the body.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
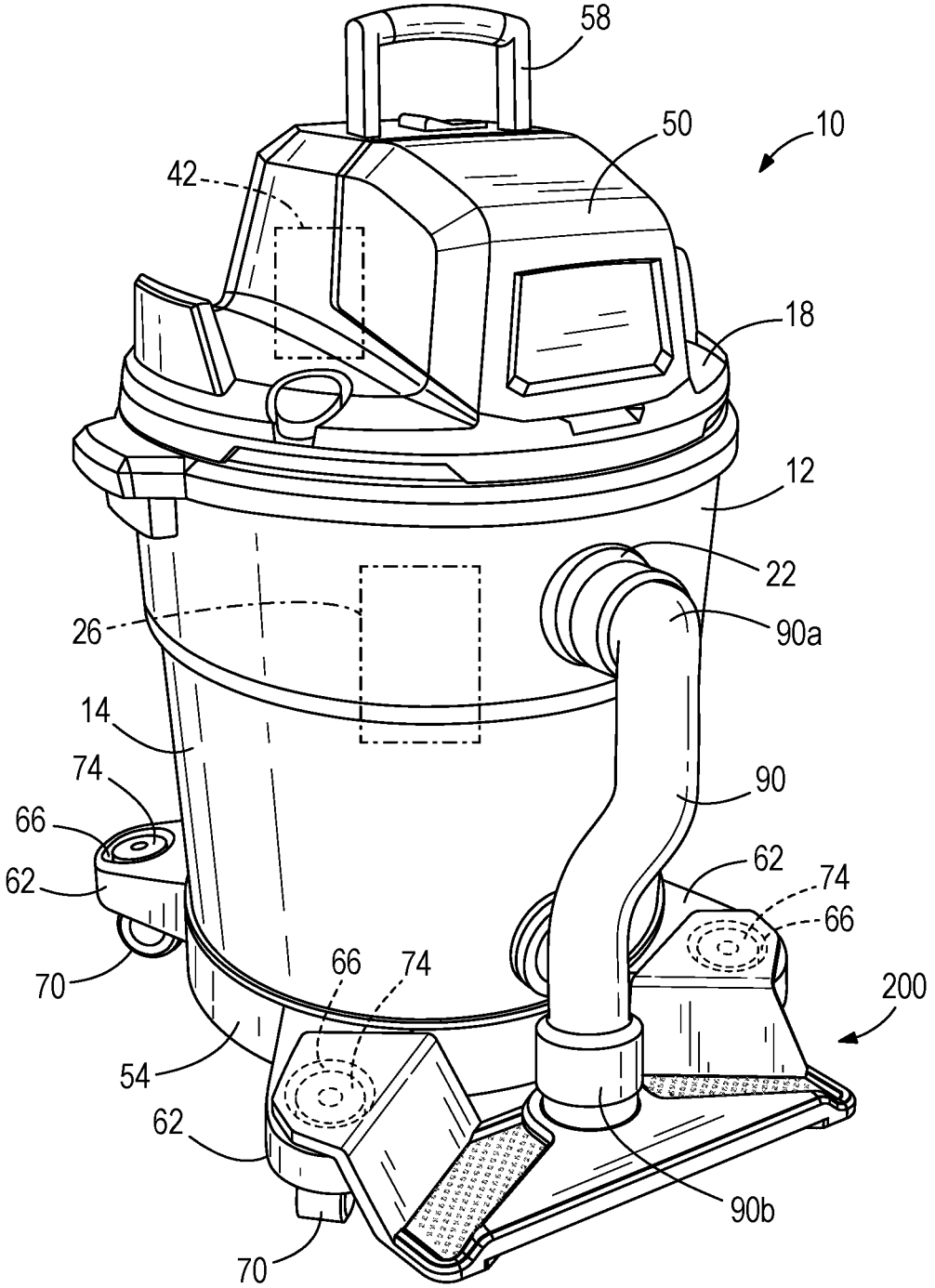
FIG. 1 illustrates an accessory tool removably coupled to a vacuum cleaner.

FIG. 1 illustrates a vacuum cleaner 10 to be coupled to an accessory tool 200. The vacuum cleaner 10 includes a body 12 movable over a surface S. The body 12 includes a base 14 and a lid 18 selectively removable from the base 14. The vacuum cleaner 10 includes a vacuum cleaner inlet 22, a separator 26, and a clean air outlet. The vacuum cleaner inlet 22 is provided on the base 14. The separator 26 is in fluid communication with the vacuum cleaner inlet 22 and is configured to separate debris (e.g., solid debris and/or liquid working fluid) from clean air. The vacuum cleaner inlet 22 may act as a suction port for the vacuum cleaner 10. The clean air outlet is in fluid communication with the separator 26 opposite the vacuum cleaner inlet 22 such that the clean air that passes through the separator 26 is exhausted through the clean air outlet to the surroundings of the vacuum cleaner 10. The illustrated base 14 functions as a debris collector to receive solid debris and/or liquid working fluid that is separated by the separator 26. In the illustrated embodiment, the illustrated vacuum cleaner 10 is a canister style wet/dry vacuum cleaner operable to vacuum solid debris and/or liquid working fluid. Optionally, a seal is provided between the base 14 and the lid 18. Other arrangements of the vacuum cleaner 10 are possible, such as an upright extractor, a stick or pole vacuum, or a handheld vacuum.

The vacuum cleaner 10 includes a motor 42 disposed in the body 12. The motor 42 is configured as a suction source to generate suction to draw fluid through the vacuum cleaner inlet 22. The motor 42 is powered by a power source 50. The power source 50 may be a battery pack which is selectively coupled to the lid 18 of the vacuum cleaner 10. Other arrangements or locations of the power source 50 are possible. For example, some embodiments may include a power cord for connecting the vacuum cleaner 10 to a main power grid for receiving alternating current.

The base 14 is supported on a chassis 54 including at least one wheel 70. A user operating the vacuum cleaner 10 may grasp a portion of the vacuum cleaner 10 to translate the vacuum cleaner 10 along a surface S towards a portion of the surface S that needs to be cleaned. The user may also lift the vacuum cleaner 10 from the surface S using a handle 58 coupled to the lid 18 to move the vacuum cleaner 10 to the portion of the surface S that needs to be cleaned.

The illustrated embodiment includes a plurality of wheels 70. The wheels 70 include caster-type wheels, which allow the vacuum cleaner 10 to slide along the surface S in any direction. The chassis 54 includes a plurality of feet 62 extending radially outwardly from the base 14. Each of the plurality of feet 62 support one of the plurality of wheels 70 below the foot 62. Each of the plurality of feet 62 include an accessory connector 74 positioned above the foot 62. The accessory connector 74 is configured to mechanically secure an accessory of the vacuum cleaner 10 to the vacuum cleaner 10. The accessory may be a suction nozzle, an extension tube, a flexible hose 90, an accessory tool such as a dustpan attachment 200, or the like. The accessory connector 74 includes an annular recess 66. The accessory may include a cylindrical end that fits within the annular recess 66. The accessory connector 74 may secure the accessory to the vacuum cleaner 10 during use or for storage of the accessory on the vacuum cleaner 10 while the accessory is not in use. The illustrated embodiment includes a plurality of accessory connectors 74 on the chassis 54. The vacuum cleaner 10 may include additional accessory storage on the lid 18. The additional accessory storage may use accessory connectors similar to accessory connectors 74 or may use different mounting methods to retain accessories.

With reference to FIG. 1, the vacuum cleaner 10 may be used with an accessory such as the flexible hose 90 to extend the inlet of the vacuum cleaner 10. The flexible hose 90 includes a first hose end 90*a*, removably coupled to the vacuum cleaner inlet 22, and a second hose end 90*b*, opposite the first hose end 90*a*, which may act as a suction port for the vacuum cleaner 10. The second hose end 90*b* may be removably secured to one of the accessory tools.

FIGS. 2-6 illustrate the accessory tool 200 formed as a dustpan attachment 200 in more detail. The accessory tool 200 may be used with other types of vacuum cleaners, such as upright cleaners, wet/dry vacuums, extractors, and more.

Figure 2:
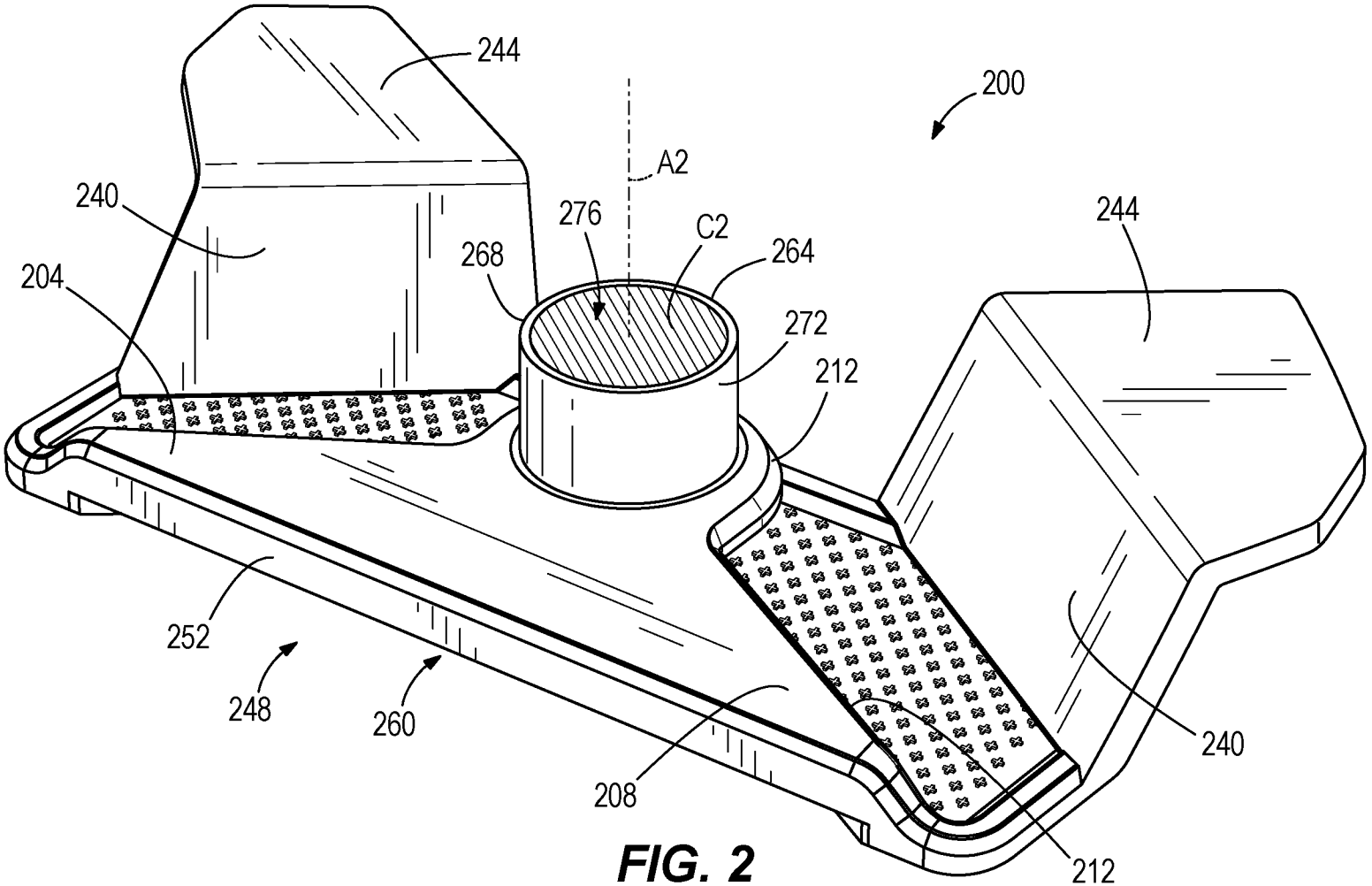
FIG. 2 illustrates a perspective view of the accessory tool of FIG. 1.
Figure 3:
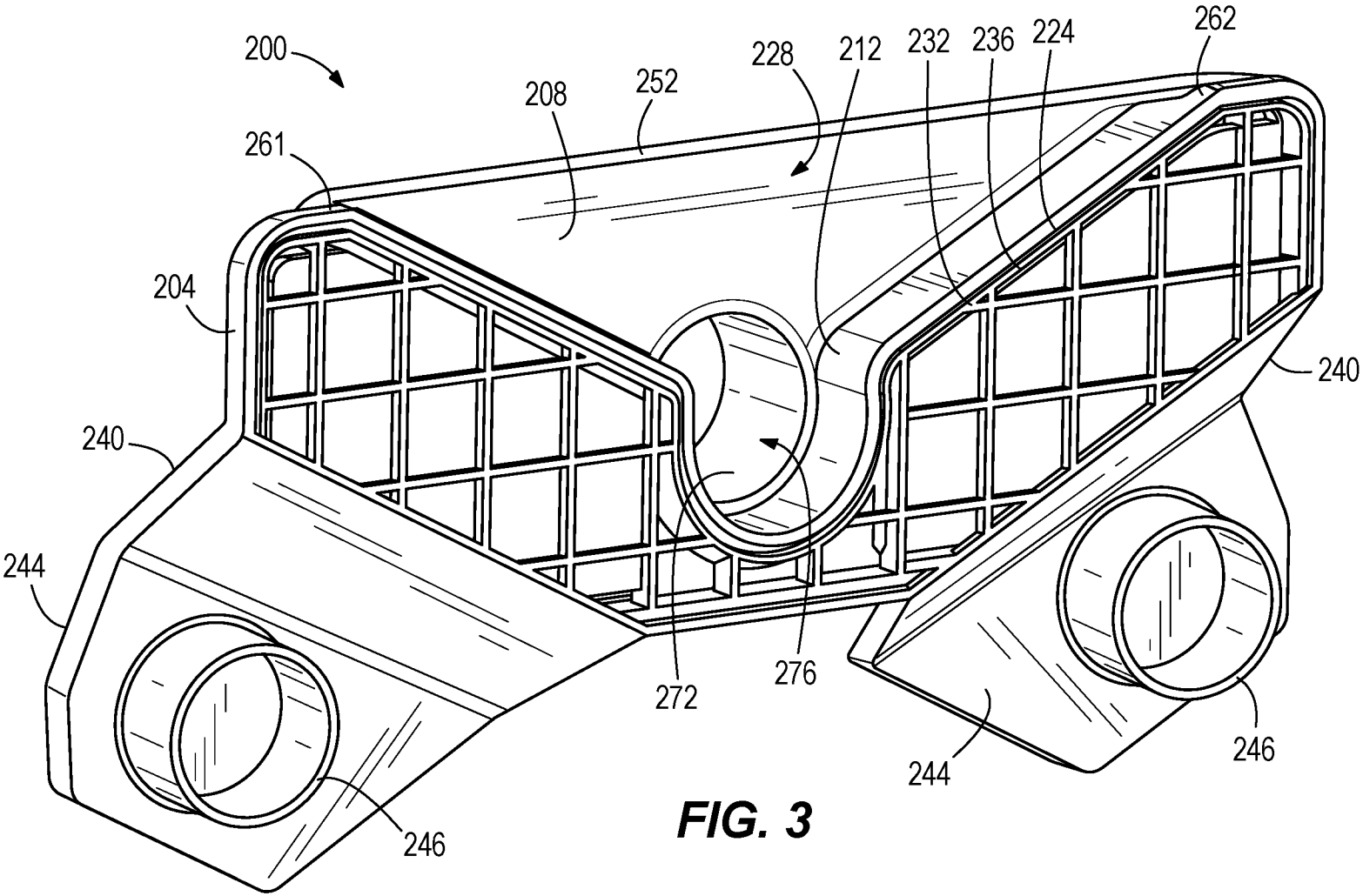
FIG. 3 illustrates a bottom perspective view of the accessory tool of FIG. 1.

As shown in FIGS. 2 and 3, the dustpan attachment 200 includes a housing 204. The housing 204 includes a top wall 208 and a plurality of walls 212 extending from the top wall 208 to a bottom edge 224. The plurality of walls 212 and the top wall 208 define a recess 228 in the housing 204, surrounded by the bottom edge 224. The bottom edge 224 may be positioned against the surface S. The bottom edge 224 includes a groove 232 to receive a sealing element 236 or sealing member 236. The sealing element 236 may include a resilient sealing material. For example, the sealing element 236 may be formed as a rubber gasket. In some embodiments, other sealing materials may be used. The sealing element 236 cooperates with the surface S when the bottom edge 224 is placed against the surface S to prevent fluid flow under the bottom edge 224.

The housing 204 includes one or more mounting surfaces 240 which may couple the accessory tool 200 to the vacuum cleaner 10. In the illustrated embodiment, the mounting surfaces 240 include a pair of flanges 244 positioned on either side of the housing 204 and extending rearwardly and upwardly from the bottom edge 224. Each flange 244 includes an annular projection 246 extending from a lower surface of the flange 244. The annular projection 246 may have a diameter sized to correspond to the diameter of the annular recess 66 of the accessory connector 74. The accessory tool 200 may be mounted on the vacuum cleaner 10 by fitting each annular projection 246 into one of the annular recesses 66. Therefore, the annular projections 246 function as a pair of attachment features on the dustpan attachment 200 and the annular recesses 66 function as a pair of mounting features on the vacuum cleaner 10. When the accessory tool 200 is mounted to the vacuum cleaner 10, the bottom edge 224 may be supported in contact with the surface S to prevent air from flowing underneath the bottom edge 224. In other embodiments, the bottom edge 224 may be supported adjacent the surface S to minimize flow underneath the bottom edge 224.

Figure 4:
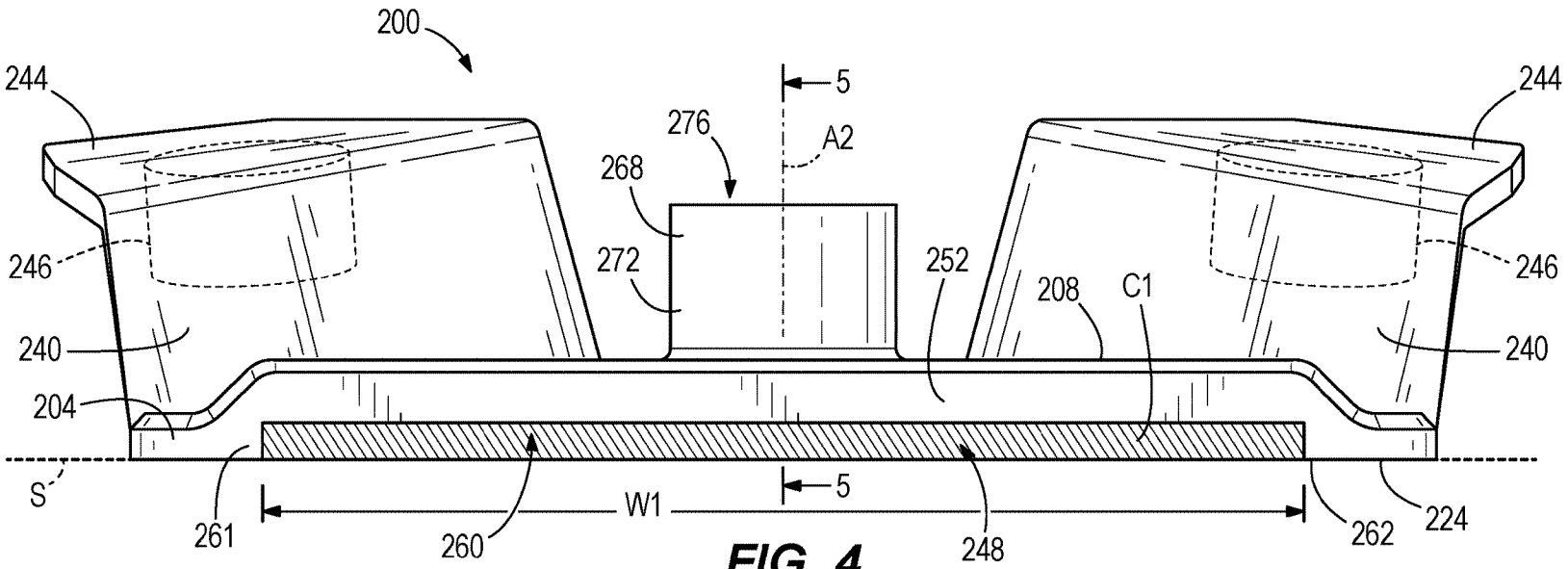
FIG. 4 illustrates a front view of the accessory tool of FIG. 1.
Figure 5:
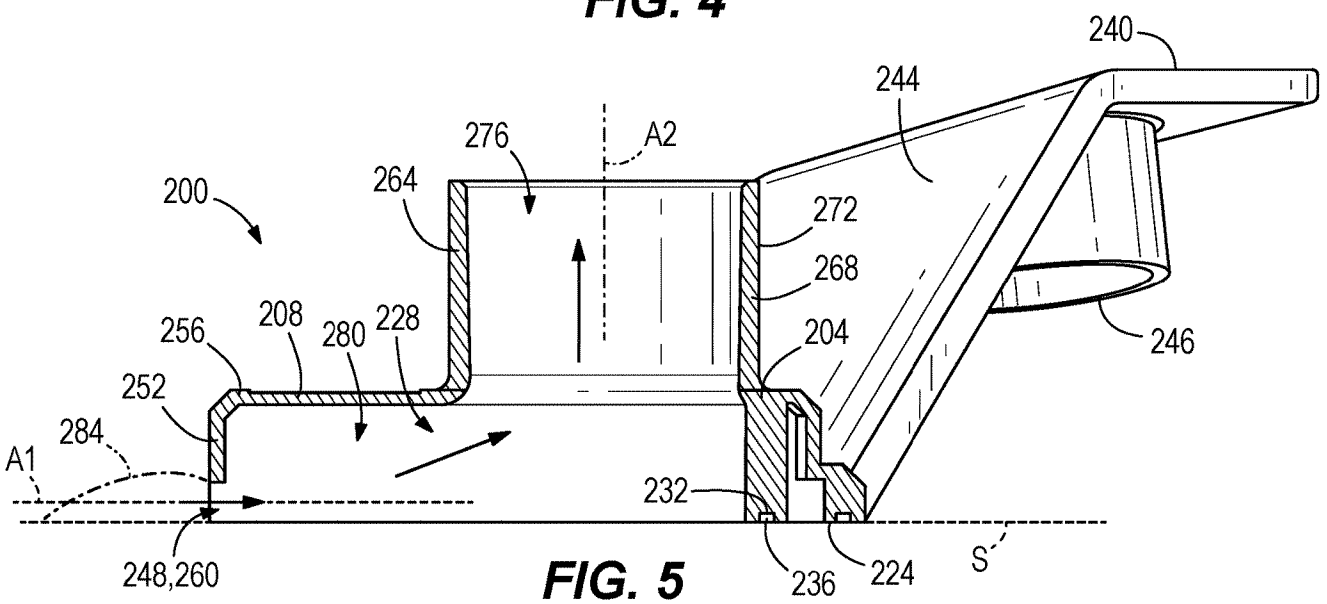
FIG. 5 illustrates a cross sectional view of the accessory tool of FIG. 1.
Figure 6:
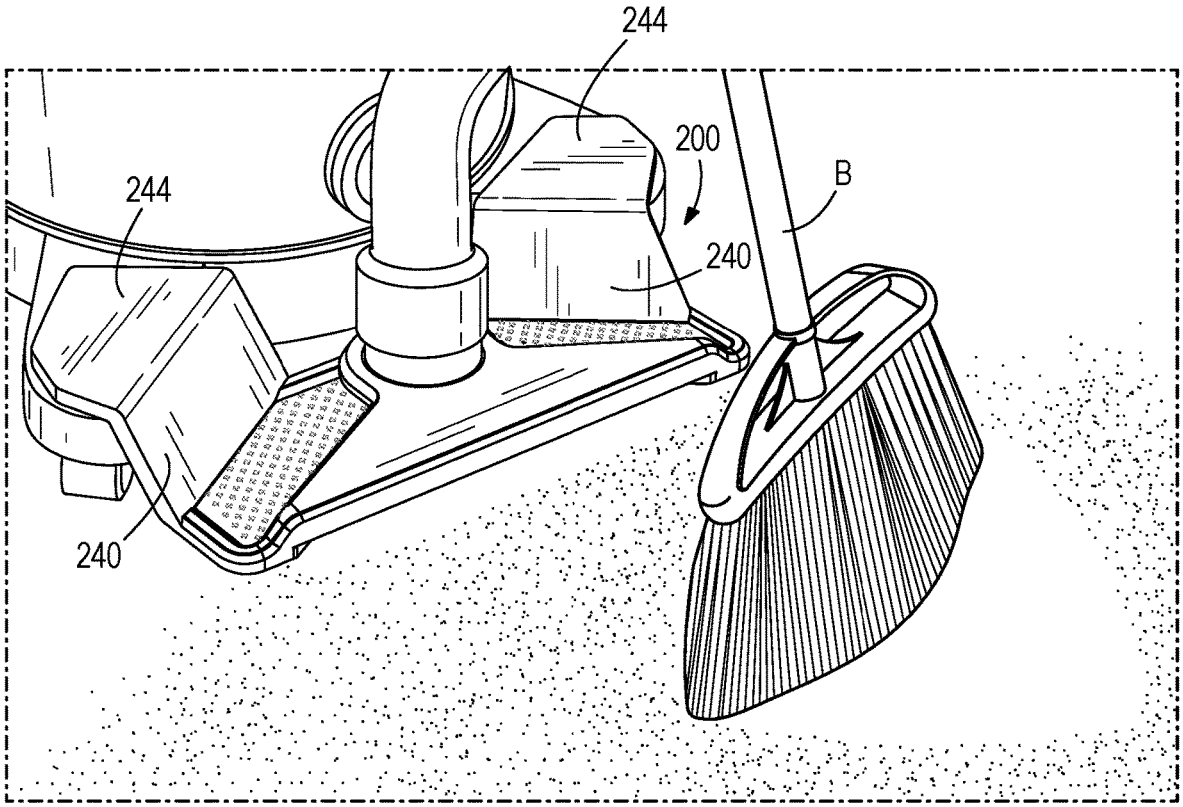
FIG. 6 illustrates the accessory tool of FIG. 1 in use with the vacuum cleaner and a sweeping implement.

With reference to FIGS. 2 and 4, the housing 204 also includes a front opening 248. In the illustrated embodiment, a front lip 252 extends from a front edge 256 of the top wall 208. The front opening 248 is positioned beneath the front lip 252 and forms a suction inlet 260 when the bottom edge 224 is positioned against the surface S. The front opening 248 opens forwardly and extends along almost the entire width of the housing 204. In some embodiments, the front opening 248 has a width W of between 6 and 20 inches. More specifically, the width W may correspond to a width of a head of a standard sweeping implement such as a broom B (FIG. 6). The suction inlet 260 extends between a first end 261 of the housing 204, adjacent one end of the suction inlet 260, and a second end 262 of the housing 204, adjacent the opposite end of the suction inlet 260. The bottom edge 224 also extends between the first end 261 and the second end 262 around the recess 228. The bottom edge 224 includes resilient sealing material continuously between the first end 261 of the housing 204 and the second end 262 of the housing 204. The suction inlet 260 extends into the housing 204 along a first axis A1 (FIG. 5). When the bottom edge 224 is positioned against the surface S, the first axis A1 is generally horizontal. The suction inlet 260 has a cross sectional area C1 (or first area C1) measured perpendicular to the first axis A1. The suction inlet 260 is generally rectangular in shape.

As shown best in FIG. 2, the dustpan attachment 200 further includes a vacuum port 264. In the illustrated embodiment, the vacuum port 264 is coupled to the top wall 208 of the housing 204. In other embodiments, the vacuum port 264 may extend from any of the plurality of walls 212, or may extend through or span multiple walls, including the top wall 208 or the plurality of walls 212. In the illustrated embodiment, the vacuum port 264 includes a connector 268 extending from the top wall 208. The connector 268 includes an outer wall 272 defining a channel 276 which extends along a second axis A2 through the housing 204 and connects to the recess 228. When the bottom edge 224 is positioned against the surface S, the second axis A2 extends generally vertically. The vacuum port 264 has a generally circular shape and a cross sectional area C2 (or second area C2) measured perpendicular to the second axis A2. The cross sectional area C2 of the vacuum port 264 is generally equal in size to the cross sectional area C1 of the suction inlet 260.

As shown in FIGS. 4 and 5, when the bottom edge 224 is positioned against the surface S, the recess 228 cooperates with the surface S to create a suction channel 280. The sealing element 236 helps to seal the suction channel 280 around the bottom edge 224. The suction channel 280 extends between the suction inlet 260 and the vacuum port 264. The suction channel 280 converges in the width direction, such that the air is funneled toward the vacuum port 264. The vacuum port 264 may be removably coupled to the flexible hose 90. This effectively moves the inlet of the vacuum cleaner 10 to the suction inlet 260 of the dustpan attachment 200. As such, the vacuum cleaner inlet 22 is in fluid communication with the suction inlet 260. When the flexible hose 90 is secured to the vacuum cleaner inlet 22 and the dustpan attachment 200, the fluid flow path extends from the suction inlet 260 of the dustpan attachment 200, through the flexible hose 90, and into the vacuum cleaner inlet 22. In some embodiments, the flanges 244 can be removed from the accessory connectors 74 and the accessory tool 200 may be movable along the surface S to a position spaced from the body 12 while connected to the vacuum cleaner inlet 22 via the flexible hose 90. This affords a range of motion for the accessory tool 200 to move relative to the base 14 and the lid 18.

As shown in FIGS. 5 and 6, while connected to the vacuum cleaner 10 and positioned with the bottom edge 224 on the surface S, a suction zone 284 (also referred to as a suction area 284) may be created adjacent to the suction inlet 260. In use, the vacuum cleaner 10 can be powered on, so that the motor 42 creates a suction flow through the vacuum cleaner 10 to the suction zone 284. An operator can use a sweeping implement such as a broom B to move debris across the surface S into the suction zone 284. Debris that enters the suction zone 284 is drawn into the dustpan attachment 200 through the suction inlet 260. Debris is then transmitted through the suction channel 280, the channel 276 of the vacuum port 264, the flexible hose 90, the vacuum cleaner inlet 22, and to the separator 26. Debris is then collected in the base 14 and clean air is exhausted through the clean air outlet. Once the surface S has been cleaned, the vacuum cleaner 10 can be powered off. The dustpan attachment 200 can be removed from the flexible hose 90. The flexible hose 90 can be removed from the vacuum cleaner inlet 22 or can be coupled to a different accessory tool. The dustpan attachment 200 can remain coupled to the accessory connectors 74 or be removed and stored elsewhere. The debris collected in the base 14 can be emptied. The vacuum cleaner 10 can be moved and stored as needed.

Various features of the invention are set forth in the following claims.

What is claimed is:

1. A vacuum cleaner comprising:

a body movable over a surface to be cleaned, the body including a plurality of feet;

a suction source positioned in the body;

a suction port in fluid communication with the suction source; and a dustpan attachment removably coupled to the body, the dustpan attachment including:

a housing including a recess and a vacuum port fluidly coupled to the suction port; and a pair of flanges extending from the housing, wherein each flange is removably coupled to a respective one of the plurality of feet;

wherein when each of the pair of flanges is mounted directly above a respective one of the plurality of feet and a respective one of a plurality of wheels, the dustpan attachment is mounted and nonrotatable relative to the body and the recess cooperates with the surface to form a suction channel having a suction inlet formed in a front of the housing and opening forwardly, wherein the suction inlet is in fluid communication with the suction port.

2. The vacuum cleaner of claim 1, further comprising a debris collector in fluid communication with the vacuum port and the suction source, wherein debris is drawn through the suction inlet and transmitted to the debris collector.

3. The vacuum cleaner of claim 2, wherein the suction source creates a suction area adjacent the suction inlet, wherein when the debris enters the suction area, the debris is drawn through the suction inlet to the debris collector.

4. The vacuum cleaner of claim 3, wherein debris can be swept into the suction area.

5. The vacuum cleaner of claim 1, wherein the housing includes a top wall and a plurality of walls extending from the top wall to a bottom edge, the bottom edge configured to contact the surface.

6. The vacuum cleaner of claim 5, wherein the vacuum port extends through the top wall.

7. The vacuum cleaner of claim 1, wherein a flexible hose is coupled between the suction port and the vacuum port.

8. The vacuum cleaner of claim 1, wherein the pair of flanges of the dustpan attachment can be removed from the vacuum cleaner and the dustpan attachment can be positioned on the surface spaced from the body.

9. The vacuum cleaner of claim 1, wherein each of the pair of flanges includes an annular projection, and each of the plurality of feet includes an annular recess, and wherein the dustpan attachment is coupled to the body by positioned the annular projections within the annular recesses.

10. The vacuum cleaner of claim 9, wherein each of the annular projections extends from a lower surface of the respective flange.

11. The vacuum cleaner of claim 1, wherein the pair of flanges extend outward and away from the recess and the housing in which the recess is formed.

12. The vacuum cleaner of claim 1, wherein each of the pair of flanges mount over the respective ones of the plurality of feet.

13. A method of using the dustpan attachment with the vacuum cleaner of claim 1 to clean a surface, the method comprising:

connecting a pair of attachment features on the pair of flanges of the dustpan attachment to the plurality of feet of the vacuum cleaner so that the dustpan attachment is mounted and nonrotatable relative to the body, thereby positioning the dustpan attachment adjacent the surface and forming the suction inlet at the front thereof;

forming the suction channel defined by the surface and the recess within the housing of the dustpan attachment;

connecting the suction port with the vacuum port of the dustpan attachment; and operating the suction source to draw air through the suction inlet into the suction channel.

14. The method of claim 13, wherein each of the plurality of feet includes an annular recess.

15. The method of claim 14, wherein each of the pair of attachment features includes an annular projection, and wherein connecting the pair of attachment features to the plurality of feet includes positioning each annular projection in a corresponding annular recess.

16. A dustpan attachment for use with a vacuum cleaner configured to clean a surface, the vacuum cleaner having a body, a suction port, and a suction source disposed in the body for generating airflow through the suction port, the dustpan attachment comprising:

a housing including a top wall defining a horizontal surface and a plurality of walls extending from the top wall to a bottom edge, the bottom edge configured to contact the surface;

a vacuum port extending through the housing, the vacuum port configured to fluidly couple to the suction port;

a recess defined within the housing, wherein when the bottom edge contacts the surface, the recess is configured to cooperate with the surface to form a suction channel having a suction inlet in communication with the vacuum port and formed in a front of the housing and opening forwardly; and a pair of flanges extending rearwardly from the housing, the pair of flanges configured to removably couple to the body, wherein when each of the pair of flanges is coupled to the body, the dustpan attachment is mounted and nonrotatable relative to the body;

each of the flanges comprise a respective annular projection extending downwardly and configured to engage a corresponding annular recess in the body.

17. The dustpan attachment of claim 16, wherein the housing defines a first end at one end of the suction inlet and a second end at an opposite end of the suction inlet and wherein the bottom edge includes a resilient sealing material extending between the first end and the second end.

18. The dustpan attachment of claim 17, wherein when the pair of flanges are coupled to the body, the resilient sealing material contacts the surface continuously between the first end and the second end.

19. The dustpan attachment of claim 16, wherein the suction inlet defines a first area, and the vacuum port defines a second area, and wherein the first area and the second area are equal in size.

20. The dustpan attachment of claim 16, wherein the vacuum port extends through the top wall of the housing.

21. The dustpan attachment of claim 20, wherein the suction channel converges in a width direction from the suction inlet to the vacuum port.

22. The dustpan attachment of claim 16, wherein the dustpan attachment can be removed from the body and positioned on the surface to be cleaned spaced from the body.

* * * * *